US011396780B2

(12) United States Patent
Johnson et al.

(10) Patent No.: US 11,396,780 B2
(45) Date of Patent: Jul. 26, 2022

(54) WRENCH FOR USE WITH MAKING AND BREAKING A DRILL STRING

(71) Applicant: Quantum Machine Works Ltd., Whitehorse (CA)

(72) Inventors: Lee Johnson, Yukon (CA); Daniel Simpson, Yukon (CA)

(73) Assignee: QUANTUM MACHINE WORKS LTD.

( * ) Notice: Subject to any disclaimer, the term of this patent is extended or adjusted under 35 U.S.C. 154(b) by 374 days.

(21) Appl. No.: 16/742,444

(22) Filed: Jan. 14, 2020

(65) Prior Publication Data

US 2021/0215006 A1 Jul. 15, 2021

(51) Int. Cl.

| | |
|---|---|
| ***E21B 19/16*** | (2006.01) |
| ***B25B 21/00*** | (2006.01) |
| ***E21B 19/18*** | (2006.01) |

(52) U.S. Cl.

CPC ..... *E21B 19/163* (2013.01); *B25B 21/002* (2013.01); *B25B 21/005* (2013.01); *E21B 19/18* (2013.01)

(58) Field of Classification Search

CPC ..... E21B 19/163; E21B 19/18; B25B 21/002; B25B 21/005; B25B 13/50

See application file for complete search history.

(56) References Cited

U.S. PATENT DOCUMENTS

| | | | |
|---|---|---|---|
| 4,194,419 A | 3/1980 | Mitchhart et al. | |
| 5,537,990 A | 7/1996 | Lee | |
| 5,791,206 A | 8/1998 | Daigle et al. | |
| 6,012,360 A | 1/2000 | Concha | |
| 8,235,104 B1 | 8/2012 | Sigmar et al. | |
| 8,424,419 B2 | 4/2013 | Connell | |
| 8,453,542 B2 | 6/2013 | Gouws | |
| 8,627,748 B2 | 1/2014 | Gouws | |
| 9,551,194 B1 * | 1/2017 | Baryam | E21B 19/163 |
| 2017/0234085 A1 | 8/2017 | Gaska et al. | |

FOREIGN PATENT DOCUMENTS

| | | | | |
|---|---|---|---|---|
| CA | 2507788 A1 * | 11/2005 | ..... | E21B 19/163 |
| CN | 112338505 A * | 2/2021 | ..... | B23P 19/04 |
| CN | 112696153 A * | 4/2021 | ..... | E21B 15/00 |
| WO | 1999006186 A1 | 2/1999 | | |

* cited by examiner

*Primary Examiner* — David B. Thomas

(74) *Attorney, Agent, or Firm* — Bracewell LLP; Brad Y. Chin

(57) ABSTRACT

Embodiments of the present disclosure relate to a wrench for loosening or tightening a threaded joint of two drill-string components. The wrench is mountable on a drill assembly. The wrench comprises: a jaw assembly with opposing jaws for engaging the drill-string component therebetween; a first actuator for actuating the pair of opposing jaws between an engaged position and a disengaged position; a second actuator configured to pivot the jaw assembly and configured for applying a torque when engaged with the drill-string component; a third actuator configured to extend and retract the jaw assembly in a first plane substantially perpendicular to the longitudinal axis of the drill assembly when the wrench is mounted on the drill assembly; and a fourth actuator for actuating the wrench in a second plane substantially perpendicular to the first plane. Embodiments of the present disclosure also relate to drilling systems comprising the wrench.

13 Claims, 7 Drawing Sheets

FIG. 1A
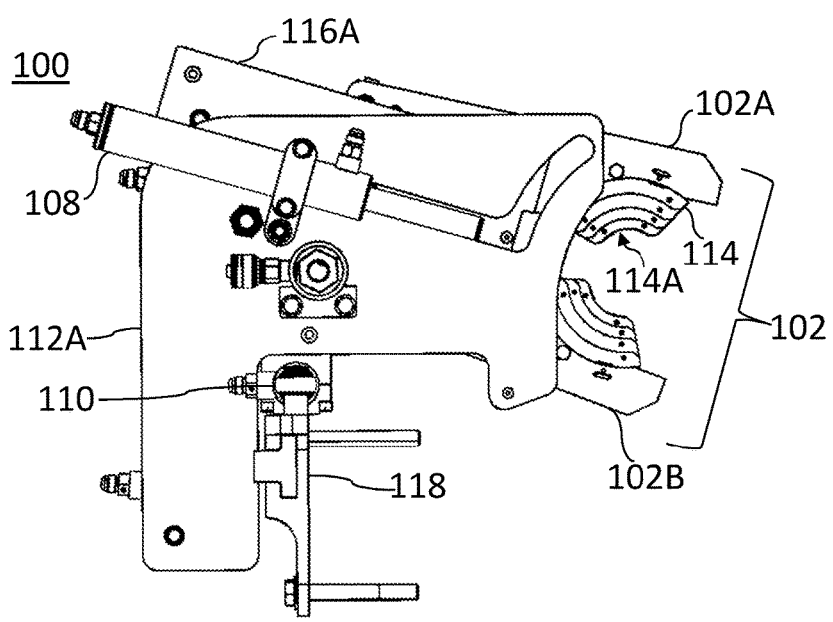
FIG. 1B
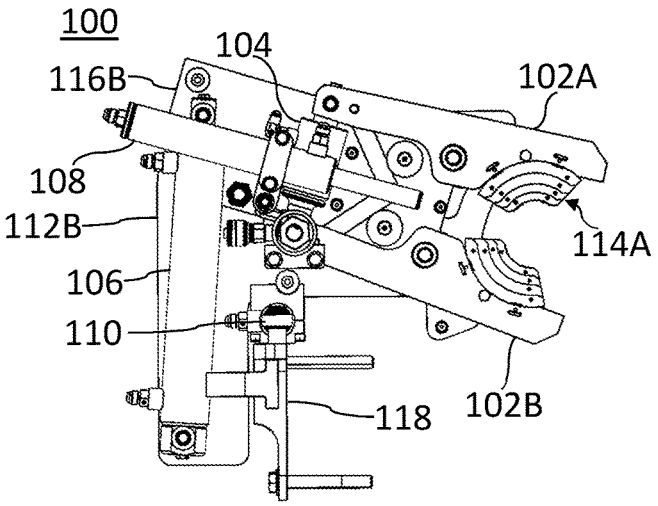
FIG. 1C
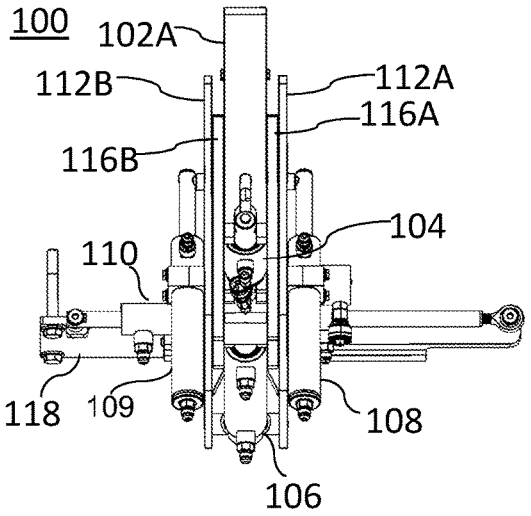
FIG. 1

FIG. 2A
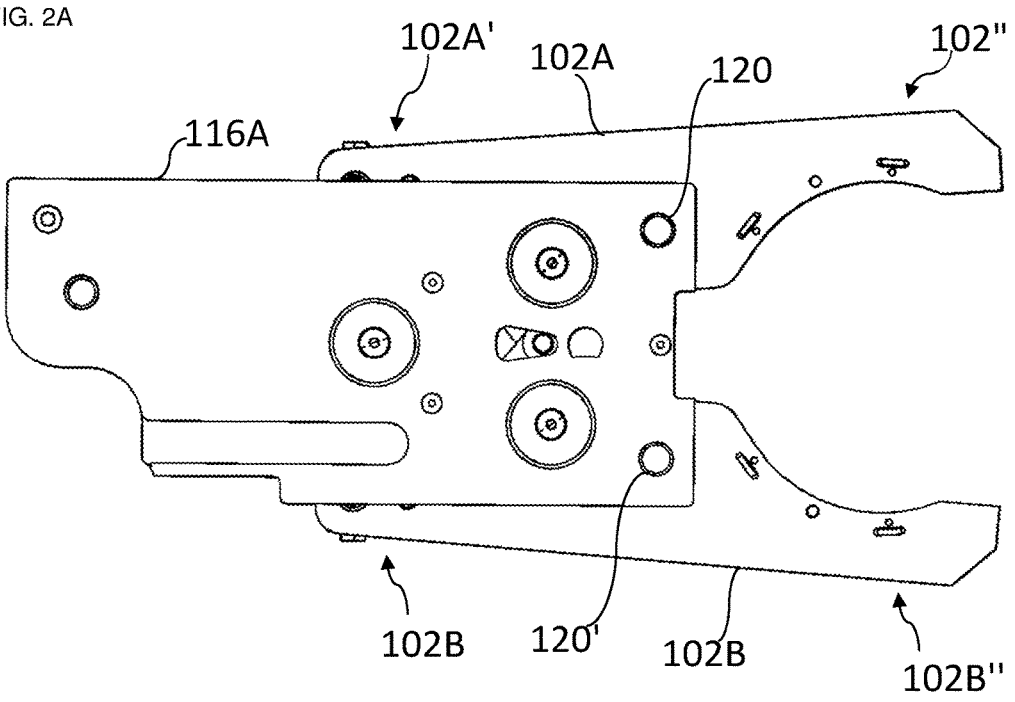
FIG. 2B
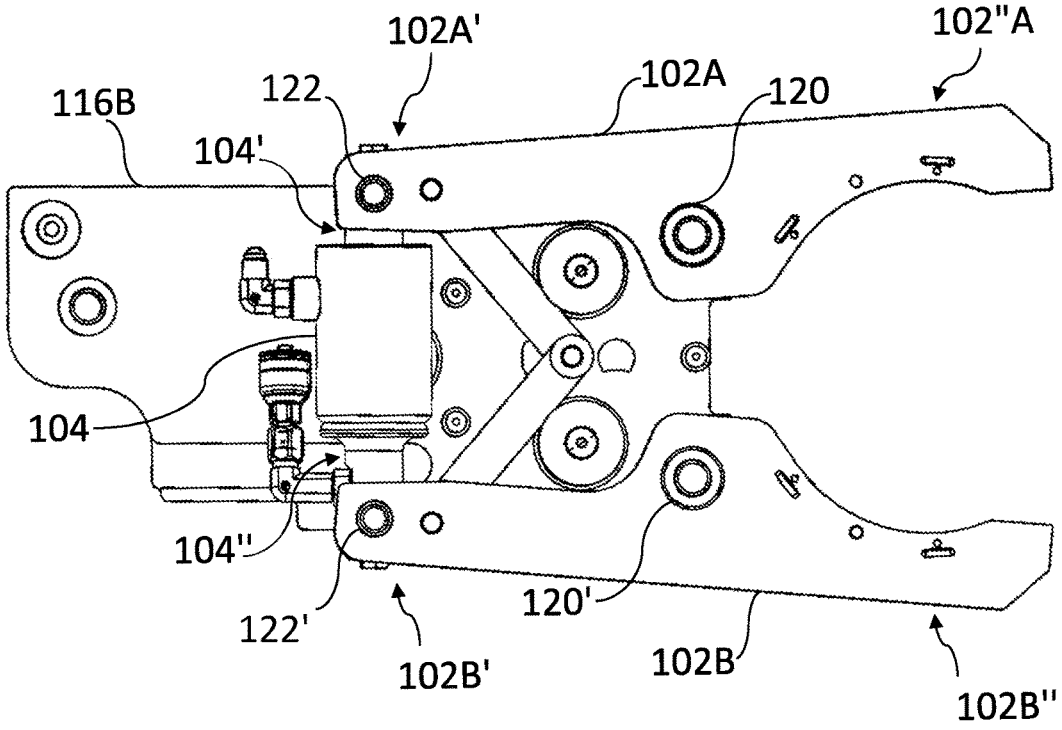
FIG. 2

FIG. 5A
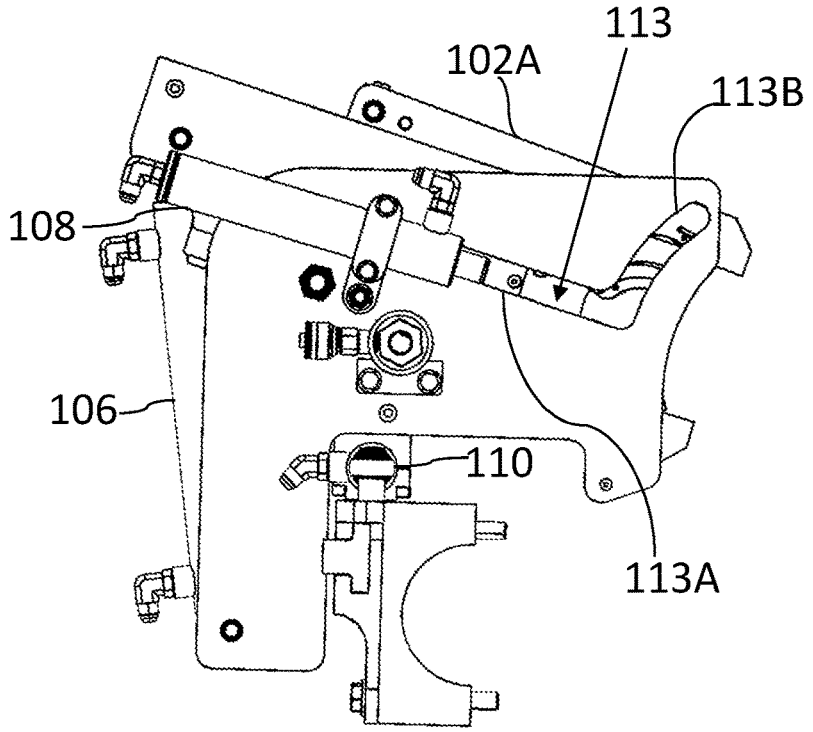
FIG. 5B
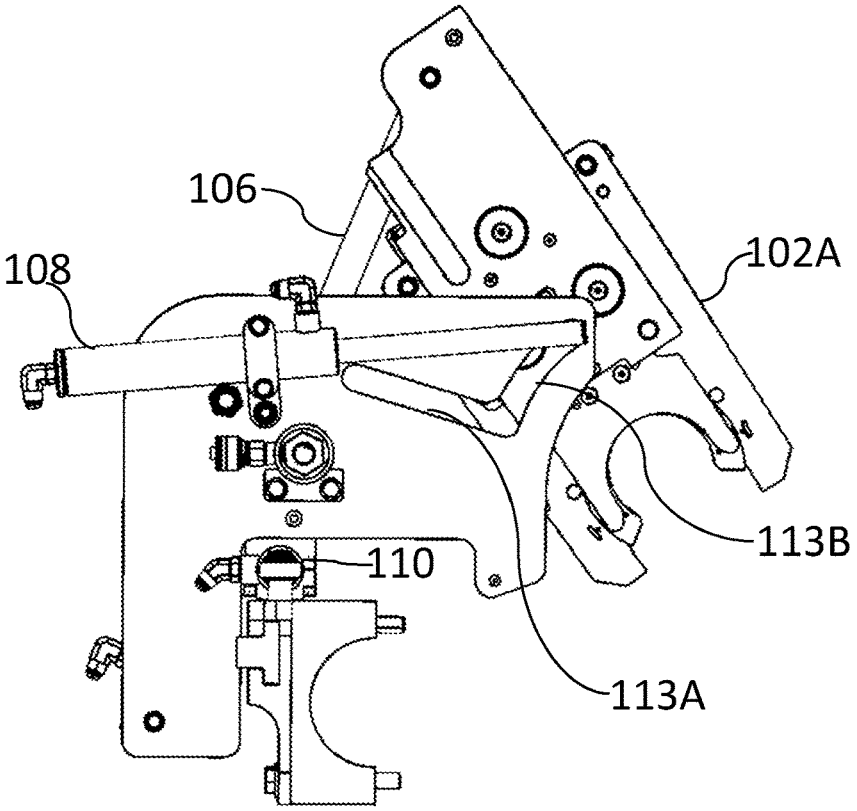
FIG. 5

FIG. 6A
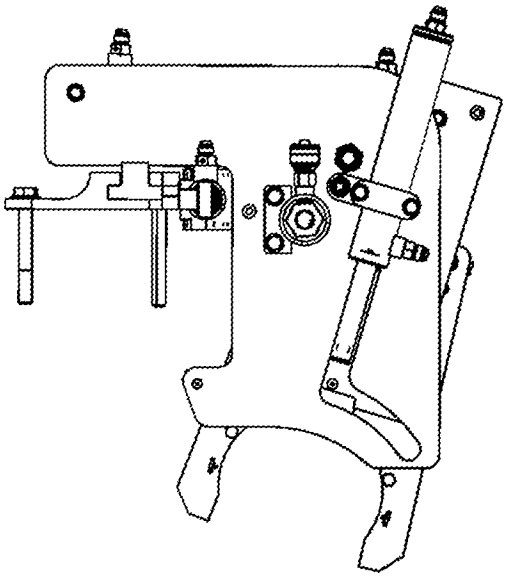
FIG. 6B
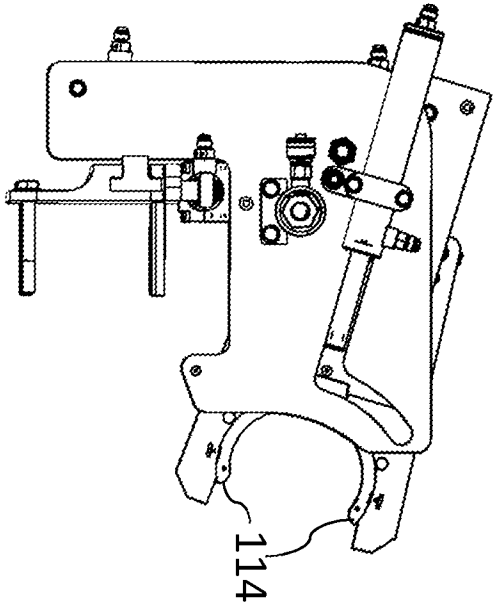
FIG. 6C
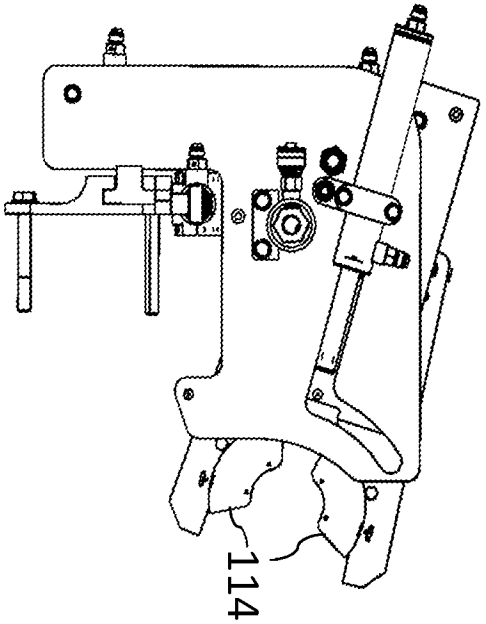
FIG. 6

FIG. 7A
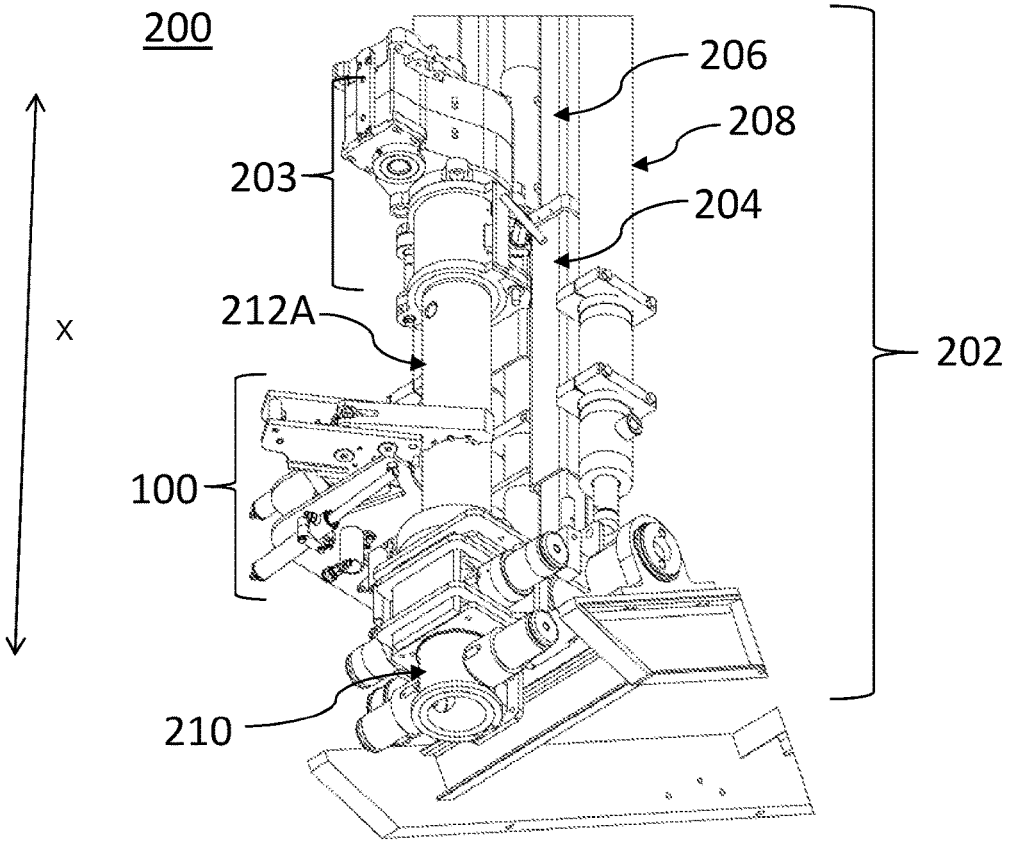
FIG. 7B
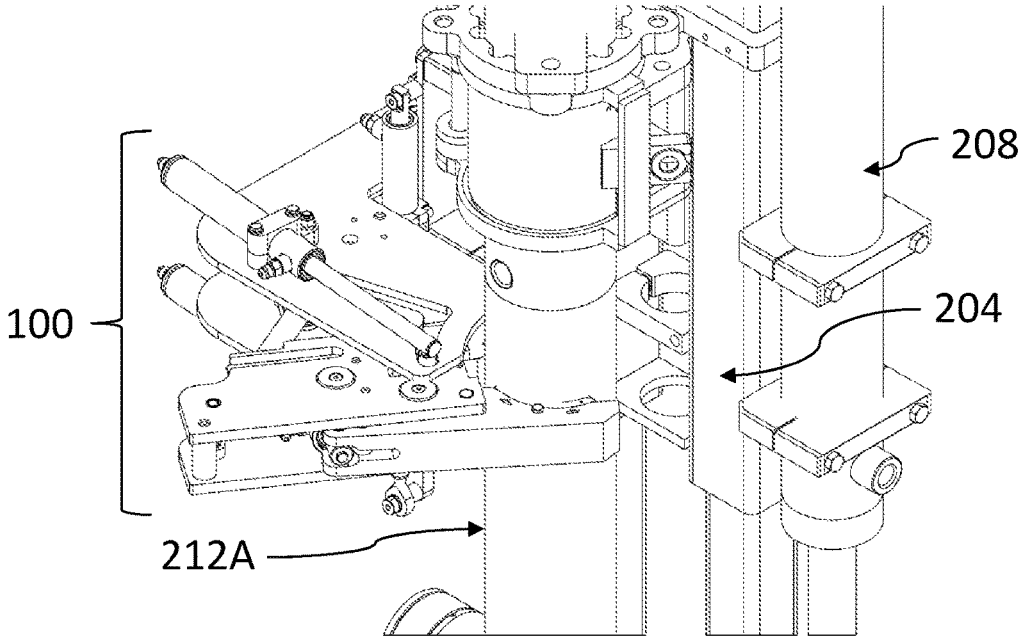
FIG. 7

WRENCH FOR USE WITH MAKING AND BREAKING A DRILL STRING

TECHNICAL FIELD

The present disclosure generally relates to an apparatus for use in drilling with a drill string that is made up of many sections of thin-walled drill pipe. In particular, the present disclosure relates to a wrench that is mountable on a drill assembly.

BACKGROUND

Earth drilling processes use a drill string to cut a borehole into the ground. The drill string generally includes multiple sections of drill pipe that are connected together with a drill bit connected at the working end of the drill string. One example of earth drilling, which is different from those used in the oil-and-gas industry, is exploration drilling. During exploration drilling a small diameter, sample of core rock is extracted from the earth to analyze one or more of structure, petrology, and mineralogy. In some examples of exploration earth drilling, the sample of core rock is obtained using a drill string that includes a hollow bit with numerous diamonds embedded in a soft metallic matrix at the end of a tubular, rotating drill-pipe, which cuts the rock and forms the sample of core rock in the center of the drill pipe. Once a predetermined length of core has been cut, the sample of core rock can be extracted from within the drill pipe.

Boreholes drilled with exploration diamond-bit drill strings can range from about 3.2 feet to about 9,842.5 feet in depth (one foot is equivalent to about 0.3 meters). Reaching a target depth generally involves assembling segments of drill pipe to form a longer drill string. Each end of a drill pipe includes threads that can be connected to the threaded ends of another drill pipe to make up a portion of the drill string. When making the drill string, the connection between drill pipes is formed by applying a high torque, which can also seal the joint between the two drill pipes to contain high-pressure fluids. Similar high torques are required to disconnect two drill pipes when breaking the drill string.

Typical drill pipe used in exploration diamond-bit drilling have an outer diameter of about 2.25 inches to about 5.5 inches (one inch is equivalent to about 2.54 centimeters) and a wall thickness between about 0.1 inches to about 0.35 inches.

Another example of exploration drilling is reverse-circulation drilling, which uses a drill string that is made up of threaded, dual-walled drill pipes with a downhole hammer to produce samples of rock cuttings. The outer diameter of dual-wall drill pipes used in reverse-circulation drilling is typically between about 2 inches and about 6 inches with a wall thickness between about 0.15 inches to about 0.75 inches.

Connecting and disconnecting the tightly connected drill pipes without distorting the thin walls is a challenge. Many existing drill pipe wrenches involve manual steps, such as manually connecting and disconnecting the threaded connections by a hand-held wrench or maneuvering the wrench to a specific location along the drill pipe. These manual steps are inefficient and require that the operator be in close physical proximity to the rotating drill head assembly and the drill bore, which may pose a safety hazard. Further, known wrenches for use during such earth drilling can have a large physical footprint, cannot easily accommodate variable diameters of the drill pipes, and cannot develop a sufficient gripping force that is required to apply the required high-torque for making and breaking the drill string.

SUMMARY

Embodiments of the present disclosure relate to a wrench for loosening and tightening threaded drill-string component connections when making and breaking a drill string.

Some embodiments of the present disclosure relate to a wrench for loosening or tightening a threaded joint of two drill-string components. The wrench comprises a jaw assembly and four actuators. The jaw assembly comprises a pair of opposing jaws configured to engage therebetween an outer surface of a first drill-string component. A first actuator is configured to actuate the pair of opposing jaws between an engaged position and a disengaged position. A second actuator is configured to pivot the jaw assembly and further configured for applying a torque to the outer surface of the first drill-string component when engaged therewith. The third actuator is configured to extend and retract the jaw assembly in a first plane. The first plane is substantially perpendicular to a longitudinal axis of the drill-string component when engageable with the jaw assembly. The fourth actuator is configured for actuating the wrench in a second plane substantially parallel to the longitudinal axis of the drill-string component when engageable with the jaw assembly.

Some embodiments of the present disclosure relate to a wrench for loosening or tightening a threaded joint of two drill-string components. The wrench comprises a jaw assembly, at least three actuators and a frame plate with a track. The jaw assembly comprises a pair of opposing jaws configured to engage therebetween an outer surface of a first drill-string component. A first actuator is configured to actuate the pair of opposing jaws between an engaged position and a disengaged position. A second actuator is configured to pivot the jaw assembly and further configured for applying a torque to the outer surface of the first drill-string component when engaged therewith. The third actuator is configured to extend and retract the jaw assembly in a first plane. The first plane is substantially perpendicular to a longitudinal axis of the drill-string component when engageable with the jaw assembly. The frame plate defines the track which is configured to guide movement of a bushing connected to an end of the third actuator. The track comprises a first portion and a second portion. The first portion is configured to position the jaw assembly in alignment with an engageable drill-string component. The second portion is configured to guide the bushing for establishing alignment between a center position of the jaw assembly and the longitudinal axis of the engageable drill-string component when the second actuator pivots the jaw assembly.

Some embodiments of the present disclosure relate to a wrench for loosening or tightening a threaded joint of two drill-string components. The wrench comprises a jaw assembly, at least three actuators and at least one jaw insert. The jaw assembly comprises a pair of opposing jaws configured to engage therebetween an outer surface of a first drill-string component. A first actuator is configured to actuate the pair of opposing jaws between an engaged position and a disengaged position. A second actuator is configured to pivot the jaw assembly and further configured for applying a torque to the outer surface of the first drill-string component when engaged therewith. The third actuator is configured to extend and retract the jaw assembly in a first plane. The first plane is substantially perpendicular to a longitudinal axis of the drill-string component when engageable with the jaw assembly. The at least one jaw insert configurable to engage with an outer surface of a first drill-string component with an outer diameter between about 2.25 inches and about 5.5 inches.

Some embodiments of the present disclosure relate to a drilling system that comprises a drill head assembly, at least one drill slide, a foot clamp, and a wrench. The wrench comprises a jaw assembly and four actuators. The jaw assembly comprises a pair of opposing jaws configured to engage therebetween an outer surface of a first drill-string component. A first actuator is configured to actuate the pair of opposing jaws between an engaged position and a disengaged position. A second actuator is configured to pivot the jaw assembly and further configured for applying a torque to the outer surface of the first drill-string component when engaged therewith. The third actuator is configured to extend and retract the jaw assembly in a first plane. The first plane is substantially perpendicular to a longitudinal axis of the drill-string component when engageable with the jaw assembly. The fourth actuator is configured for actuating the wrench in a second plane substantially parallel to the longitudinal axis of the drill-string component when engageable with the jaw assembly.

Some embodiments of the present disclosure relate to a drilling system that comprises a drill head assembly, at least one drill slide, a foot clamp, and a wrench. The wrench comprises a jaw assembly, at least three actuators and a frame plate with a track. The jaw assembly comprises a pair of opposing jaws configured to engage therebetween an outer surface of a first drill-string component. A first actuator is configured to actuate the pair of opposing jaws between an engaged position and a disengaged position. A second actuator is configured to pivot the jaw assembly and further configured for applying a torque to the outer surface of the first drill-string component when engaged therewith. The third actuator is configured to extend and retract the jaw assembly in a first plane. The first plane is substantially perpendicular to a longitudinal axis of the drill-string component when engageable with the jaw assembly. The frame plate defines the track which is configured to guide movement of a bushing connected to an end of the third actuator. The track comprises a first portion and a second portion. The first portion is configured to position the jaw assembly in alignment with an engageable drill-string component. The second portion is configured to guide the bushing for establishing alignment between a center position of the jaw assembly and the longitudinal axis of the engageable drill-string component when the second actuator pivots the jaw assembly.

Some embodiments of the present disclosure relate to a drilling system that comprises a drill head assembly, at least one drill slide, a foot clamp, and a wrench. The wrench comprises a jaw assembly, at least three actuators and at least one jaw insert. The jaw assembly comprises a pair of opposing jaws configured to engage therebetween an outer surface of a first drill-string component. A first actuator is configured to actuate the pair of opposing jaws between an engaged position and a disengaged position. A second actuator is configured to pivot the jaw assembly and further configured for applying a torque to the outer surface of the first drill-string component when engaged therewith. The third actuator is configured to extend and retract the jaw assembly in a first plane. The first plane is substantially perpendicular to a longitudinal axis of the drill-string component when engageable with the jaw assembly. The at least one jaw insert configurable to engage with an outer surface of a first drill-string component with an outer diameter between about 2.25 inches and about 5.5 inches.

Without being bound by any particular theory, the embodiments of the present disclosure relate to a portable wrench for use with an exploratory drill assembly that can effectively engage with thin walls of a drill string to loosen or tighten the threaded components of drill pipe while minimizing or avoiding damaging drill pipe. The embodiments of the present disclosure also provide a wrench that can make or break threaded joints at different locations along the drill string and that can accommodate a range of drill pipe diameters. The embodiments of the present disclosure may also improve operator safety in exploratory drilling operations by removing the need for an operator to be physically close to the drill head assembly during making and breaking of the drill string and the connections thereof.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

FIG. 1 shows a wrench according to embodiments of the present disclosure, wherein FIG. 1A is a top plan view of the wrench in an operational position;

FIG. 1B is a top plan view of the wrench in an operational position with a frame plate and a jaw plate removed; and FIG. 1C is a side elevation view of the wrench.

FIG. 2 shows a jaw assembly and jaw frame for use with the wrench of FIG. 1, wherein FIG. 2A is a top plan view of a pair of opposed jaws; and, FIG. 2B shows the opposed jaws of FIG. 2B with a jaw frame plate removed.

FIG. 5 is two top plan views of the wrench of FIG. 1, wherein in FIG. 5A the wrench is shown in a home position; and, FIG. 5B show the wrench in a fully extended operational position.

FIG. 6 is a top plan view of a wrench according to embodiments of the present disclosure, wherein FIG. 6A shows a first arrangement of jaw inserts; FIG. 6B shows a second arrangement of jaw inserts; and, FIG. 6C shows a further arrangement of jaw inserts.

FIG. 7 shows one embodiment of a drilling assembly that includes a wrench, according to embodiments of the present disclosure, that is mounted and for use on an exploration drilling apparatus, wherein FIG. 7A shows a lower isometric view of the drilling system; and, FIG. 7B is a magnified, upper isometric view of the wrench engaged with a segment of drill pipe.

DETAILED DESCRIPTION

Definitions

Figure 3:
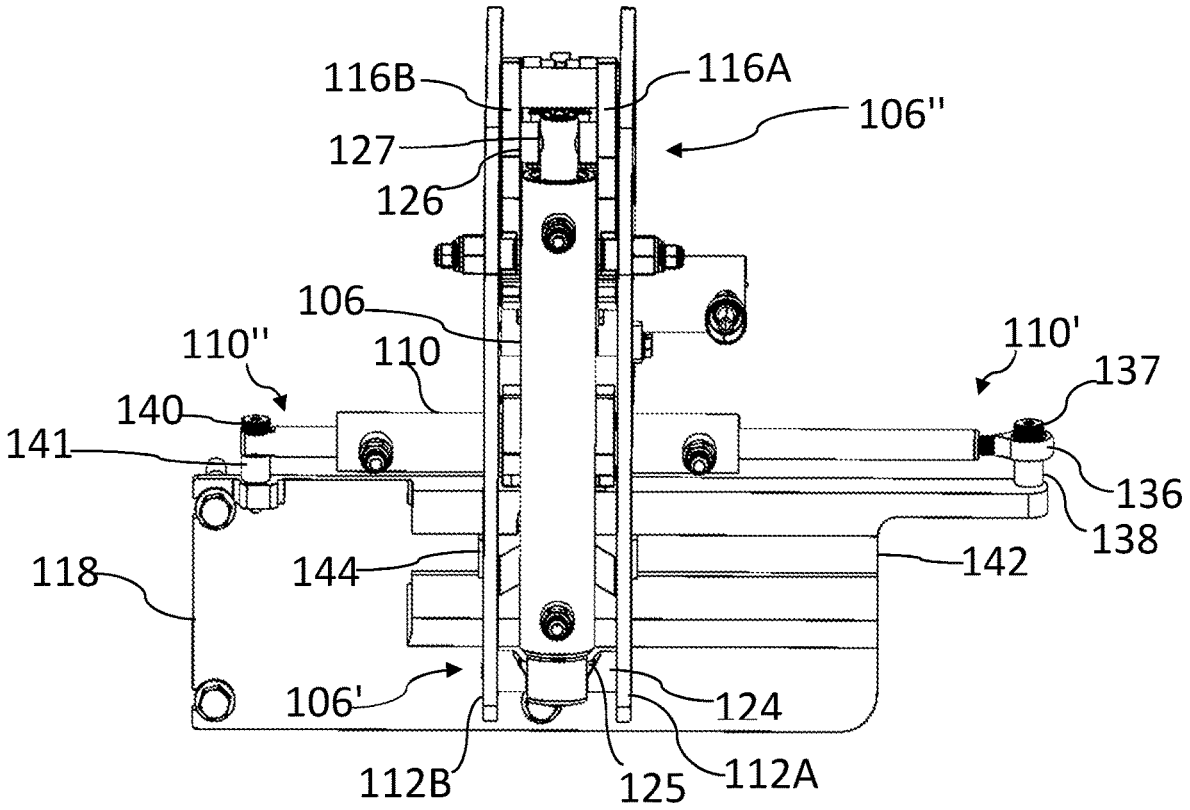
FIG. 3 is a side elevation view of the wrench of FIG. 1, wherein select components have been removed to show the connectivity of the second actuator.

Unless defined otherwise, all technical and scientific terms used herein have the same meaning as commonly understood by one of ordinary skill in the art to which this disclosure pertains.

In the present disclosure, all terms referred to in singular form are meant to encompass plural forms of the same.

Likewise, all terms referred to in plural form are meant to encompass singular forms of the same.

As used herein, the term "about" refers to an approximately +/−10% variation from a given value. It is to be understood that such a variation is always included in any given value provided herein, whether or not it is specifically referred to.

As used herein, the term "break joint" or "breaking a joint" refer to unthreading or loosening a threaded joint between two segments of drill pipe for disassembling a drill string.

As used herein, the term "drill assembly" refers collectively to the components of a drilling rig that drills boreholes in the ground by rotating and advancing (or retreating) a drill string. A drill assembly includes a drill head assembly, one or more drill slides, one or more drill slide rails, and feed cylinders or motors.

As used herein, the term "drill pipe" refers to a hollow tubular member comprising threaded ends for connecting more than one drill pipe to form part of a drill string. Drill pipes are typically about 2 feet to about 10 feet in length and are generally comprised of steel.

As used herein, the term "drill string" refers to multiple segments of drill-string components that that are threaded together. The drill-string components include drill pipe, with a drill bit at one that is configured to rotate and extract a sample of core rock from a target location. The drill-string components may also include other portions of the drill string, such as the connections made between the drill motor and the drill sub, and the drill sub and the rest of the drill string.

As used herein, the terms "make joint" or "making a joint" refer to threading together or tightening a threaded joint between two segments of drill-string components for making a drill string.

Embodiments of the present disclosure will now be described with reference to FIG. 1 through FIG. 7, which show embodiments of a wrench for loosening or tightening a threaded joint of a drill-string component. The embodiments of the present disclosure that relate to a wrench may be used in exploration drilling operations, such as diamond-bit drilling operations and reverse circulation drilling operations, for extracting a sample of core rock.

FIG. 1 shows a top plan view of one embodiment of a wrench 100 in an operational position. The wrench 100 comprises a jaw assembly 102 that has a pair of opposing jaws 102A, 102B. The opposing jaws 102A, 102B are configured to engage an outer surface of a component of a drill string, for example a segment of thin-walled drill pipe 212A (see FIG. 7). In some embodiments, the wrench 100 further comprises a first actuator 104, a second actuator 106, a third actuator 108, and a fourth actuator 110. As described further below, each actuator 104, 106, 108 and 110 is configured to move a portion of the wrench 100 relative to other portions of the wrench 100 and within one or more planes.

The wrench 100 further comprises a frame plate 112A that is configured for supporting the jaw assembly 102. In some embodiments, the frame plate 112A is a pair of frame plates 112A, 112B each configured to define a cavity therebetween to receive and support the jaw assembly 102 therein. In some embodiments, one or both of the plates in the pair of frame plates 112A, 112B may have a substantially L-shape. In other embodiments, one or both of the plates in the pair of frame plates 112A, 112B may comprise a substantially rectangular shape or any other suitable shape.

In some embodiments, the pair of opposing jaws 102A, 102B may comprise at least one jaw insert 114 configurable to engage with the outer surface of the thin-walled drill pipe. In some embodiments, the at least one jaw insert 114 is configured to engage with a drill-string component having an outer diameter between about 2.25 inches and about 5.5 inches. In some embodiments, the pair of opposing jaws 102A, 102B comprise the at least one jaw insert 114 in an arrangement that permits the addition or removal of one or more jaw inserts 114 so that the opposing jaws 102A, 102B can be configured to engage the outer surface of different drill pipe with different outer diameters.

In some embodiments, the jaw assembly 102 further comprises a jaw frame plate 116A. In some embodiments, the jaw frame plate is a pair of jaw frame plates 116A, 116B configured to provide a cavity to receive the pair of opposing jaws 102A, 102B.

In some embodiments of the present disclosure, the wrench 100 may further comprise a mounting member 118 configured to mount the wrench on the drill assembly.

FIG. 2 shows a top plan view of the jaw assembly 102 when in an operational position. In some embodiments of the present disclosure, the jaw frame plate 116A may be adjacent to the frame plate 112A. In some embodiments, the jaw frame plate 116A may be substantially within the cavity provided by the pair of frame plates 112A, 112B.

In some embodiments, each of the pair of opposing jaws 102A, 102B may be supported and pivotally connected to the jaw frame plate 116A, a second jaw frame plate 116B or the pair of jaw frame plates 116A, 116B by at least one pin 120, 120' (see FIG. 2). The skilled person will appreciate that the at least one pin 120, 120' may be a fastener other than a pin, for example, a dowel, rivet, or any other suitable fastener.

The first actuator 104 has a first end 104' and a second end 104". In some embodiments, the first end 104' is pivotally connected to a first end 102A' of the jaw 102A by a first pin 122 and the second end 104" is pivotally connected to a first end 102B' of the jaw 102B by a second pin 122'. In some embodiments, the first actuator 104 may be configured for actuating the pair of opposing jaws between an engaged position and a disengaged position. As used herein, the term "engaged position" refers to a position wherein the pair of opposing jaws 102A, 102B have moved towards each other, about their respective pins 120, 120' in order to grip or clamp the outer surface of a drill pipe. As used herein, the terms "grip" and "clamp" are used to refer to contacting the outer surface of the drill-string component in a manner that maintains the contact while the wrench applies a torque thereto, as described further below. As used herein, the term "disengaged position" refers to a position wherein the pair of opposing jaws 102A, 102B have moved away from each other so that they are not engaged with the outer surface of the drill-string component. In some embodiments of the present disclosure, the first actuator 104 may be a linear actuator or any other type of actuator that is suitable for moving the opposing jaw 102A, 102B between the engaged position and the disengaged position.

Referring to FIG. 3, the second actuator 106 has a first end 106' and a second end 106". In some embodiments, the second actuator 106 may be pivotally connected to the frame plate 112A, a second frame plate 112B or the pair of frame plates 112A, 112B at the first end 106' by at least one optional spacer 124 and a pin 125. In some embodiments, the second actuator 106 may be pivotally connected at the second end 106" to the first jaw frame plate 116A, the second jaw frame plate 116B or the pair of jaw frame plates 116A, 116B by one or both of an optional spacer 126 and a pin 127. Non-limiting examples of the pins 125 and 127 of the present disclosure include a cylindrical pin, a rod, and a dowel. As used herein, the term "spacer" refers to an optional component that is configured to separate two parts of the wrench 100. The spacers 125 and 126 may be cylindrical, spherical, or any suitable shape. In some embodiments, the spacer 124 is configured to receive the pin 125 therein and the spacer 126 is configured to receive the pin 127 therein.

In some embodiments, the second actuator 106 may be configured to pivot the jaw assembly 102 between a first position and second position for applying a torque to an outer surface of a drill-string component when engaged therewith. Torque can be measured in the units of pound-foot (lb-ft), wherein one pound-foot is the torque created by one pound of force acting at a perpendicular distance of one foot from a pivot point. One pound-foot is the equivalent of about 1.34482 Newton meters. In some embodiments, the torque is applied in a first direction and at such an amplitude that is sufficient to loosen the threaded joints of the drill-string component when the pair of opposing jaws 102A, 102B are engaged with the outer surface of the drill-string component without damaging the thin-walls of the drill-string component. In some embodiments, the torque is applied in a second direction and of such an amplitude that is sufficient to tighten the threaded joints of the drill-string component when the pair of opposing jaws 102A, 102B are engaged with the outer surface of the drill-string component. In some embodiments, extending the second actuator 106 can provide a torque in the first direct of between about 1 lb-ft and about 6200 lb-ft. In some embodiments, retracting the second actuator 106 provides a torque in the second direction between about 1 and about 3,400 lb-ft.

In some embodiments of the present disclosure, extending the second actuator 106 when the pair of opposing jaws 102A, 102B is engaged with the drill pipe 212A loosens the threaded joint of the drill pipe 212A and retracting the second actuator 106 when the pair of opposing jaws 102A, 102B is engaged with the drill pipe 212A tightens the threaded joint of the drill pipe 212A, or vice versa.

Figure 4:
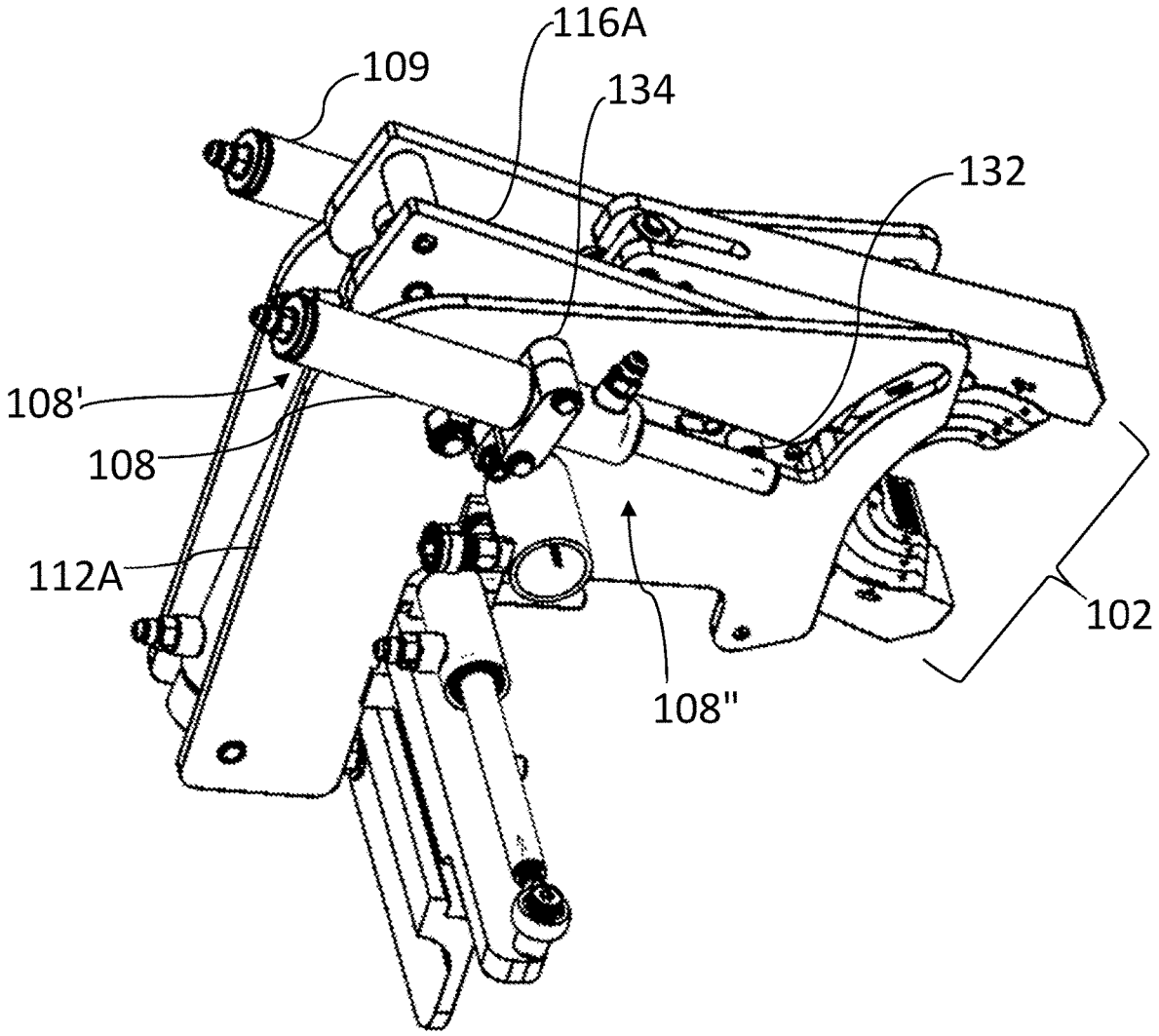
FIG. 4 is an isometric view of the wrench of FIG. 1.

As shown in FIG. 4, the third actuator 108 has a first end 108' and a second end 108". In some embodiments, the second end 108" is connected to the first jaw frame plate 116A by a bushing 132. In some embodiments, the bushing 132 may comprise a shaft 133. The skilled person will appreciate that the bushing 132 may be replaced by a lug or any other suitable bearing. In some embodiments, the third actuator 108 is connected to the frame plate 112A by a bracket 134. The skilled person will appreciate that bracket 134 may be replaced by any suitable means for securing the third actuator 108 to the frame plate 112A.

The third actuator 108 may be configured to extend and retract the jaw assembly 102 in a first plane. The first plane is substantially perpendicular to a longitudinal axis of the drill assembly, which is substantially parallel to a longitudinal axis of a drill-string component that is positioned within the drill assembly to be engaged by the jaw assembly 102 (see line X in FIG. 7) when the wrench is mounted on the drill assembly. The first plane is also substantially perpendicular to the longitudinal axis of the drill-string component when engaged within the jaw assembly 102.

In some embodiments of the present disclosure, the third actuator 108 is a pair of actuators 108, 109. In some embodiments wherein the third actuator 108 is a pair of actuators 108, 109, the third actuator 109 is connected to the second jaw frame plate 116B by a second bushing 132'. In some embodiments, the shaft 133 may be configured to connect both the third actuator 108 and the additional third actuator 109 to the jaw frame 116 or a second shaft 133' may be used to connect the additional third actuator 109 to the second jaw frame plate 116B. In some embodiments the additional third actuator may be connected to the second frame plate 112B by a second bracket 134'. The skilled person will appreciate that bracket 134' may be replaced by any suitable means for connecting the additional third actuator 109 to the frame plate 112B.

FIG. 5 depicts embodiments of the wrench 100 of the present disclosure in a home position (FIG. 5A) and an extended position (FIG. 5B). The home position refers to when the jaw assembly 102 is in the disengaged position and it is retracted away from a position where the outer surface of a pipe component can be engaged. For example, the home position may be achieved by the first actuator 104, the second actuator 106, and the third actuators 108 (and optionally 109) all being retracted. However, in other embodiments, the home position may be achieved by a combination of retracting or extending the actuators 104, 106, 108.

In some embodiments of the present disclosure, one or both of the frame plate 112A and the second frame plate 112B define a track 113 that is configured to guide the movement of the bushing 132 (and optional second bushing 132') that is connected to the second end 108" of the third actuator 108. The track 113 may comprise a first portion 113A that extends in a first direction and second portion 113B that extends in a second and different direction (see FIG. 5). The track 113 may also be referred to as a slot, groove, channel, or raised guide member. In some embodiments of the present disclosure, the first portion 113A is configured to position the pair of opposing jaws 102A, 102B into alignment with the drill-string component that is desired to be engaged when the third actuator 108 extends and retracts the jaw assembly 102. The second portion 113B is configured to guide the bushing 132 to establish and maintain alignment between a center position of the jaw assembly 102 and the longitudinal axis of the engageable drill-string component when the second actuator 106 pivots the jaw assembly 102.

Referring back to FIG. 3, the fourth actuator 110 has a first end 110' and a second end 110". In some embodiments of the present disclosure, the first end 110' is connected to the mounting member 118 by a ball joint 136 and a shoulder bolt 137. In some embodiments, the first end 110' is connected to the mounting member 118 by a ball joint and shoulder bolt 136, the shoulder bolt 137, and a spacer member 138. In some embodiments the second end 110" may be connected to the mounting member 118 by a shoulder bolt 140 and spacer unit 141. The skilled person will appreciate that the first end 110', the second end 110", or both may be connected to the mounting member 118 by any suitable connecting means.

In some embodiments of the present disclosure, the mounting member 118 is configured to mount the wrench 100 to a drill slide assembly 204 of the drill assembly 202. In some embodiments, the mounting member 118 comprises a track 142 configured to receive a sliding member 144. In some embodiments, the sliding member 144 is operatively couples to one or both of the frame plate 112A and the second frame plate 112B. In some embodiments the sliding member 144 may comprise a T-shape. In some embodiments, the fourth actuator 110 is configured to actuate the wrench 100 in a second plane. The second plane is substantially perpendicular to the first plane and substantially parallel to the longitudinal axis of a drill-string component that is positioned within the drill assembly to be engaged by the jaw assembly 102 (see line X in FIG. 7) when the wrench is mounted on the drill assembly. In some embodiments, extending the fourth actuator 110 moves the sliding member 144 along the track 142. Movement in the second plane can position the wrench 100 at a desired location along the longitudinal axis of the drill-string component when it is positioned to be engaged by or when it is engaged by the jaw assembly 102. At least one advantage of the fourth actuator 110 is that the making or breaking of the drill string is not limited to a single location on the drill-string component, for example the drill pipe 212A, and the wrench 100 can be moved to any desired position along the longitudinal axis of the drill-string component.

As will be appreciated by those skilled in the art, the actuators 104, 106, 108 and 110 can be linear actuators that are configured to move the applicable components of the wrench 100 as described above. In some embodiments of the present disclosure, the linear actuator may be any one of a hydraulically-powered cylinder, a pneumatically-powered cylinder, an electrically-powered cylinder. The actuators 104, 106, 108 and 110 may be of the same type of actuator but not necessarily. Furthermore, each actuator 104, 106, 108 and 110 is controlled by a controller circuit (not shown) that is, in turn, controlled by an operator using a user interface.

FIG. 6 shows embodiments of the wrench 100 comprising the at least one jaw insert 114, or not. FIG. 6A depicts an embodiment wherein the at least one jaw insert is absent. FIGS. 6B and 6C depict non-limiting embodiments wherein the pair of opposing jaws 112A, 112B comprise the at least one jaw insert 114 on each jaw. At least one advantage of the jaw inserts 114 is that the jaw assembly 102 can be configured to engage with drill-string components of different outer diameters because jaw inserts 114 can be of different sizes to accommodate engaging different drill-string components that have different outer diameters without having to make further substantial adjustments in the components of the wrench 100. The at least one interchangeable jaw insert 114 may be serrated, or not. In some embodiments, each of the interchangeable jaw insert 114 may be releasably secured to an inner surface of the pair of opposing jaws 102A, 102B by a retainer pin. The skilled person will appreciate that other suitable connectors to releasably secure the at least one interchangeable jaw insert 114, for example a threaded screw or nut and bolt, may be used.

FIG. 7 shows an embodiment of a drilling system 200 of the present disclosure wherein the wrench 100 is mounted to the drill slide assembly 204 by the mounting member 118. In some embodiments, feed cylinders 208 of the drill assembly 202 actuate the drill slide assembly 204 relative to the slide rails 206 and the wrench 100 moves with the drill slide assembly 204. In some embodiments, feed motors of the drill assembly 202 actuate the movement of the drill slide assembly 204.

In some embodiments of the present disclosure, the drill assembly is an exploratory drill assembly, such as a diamond bit or reverse circulation exploratory drill assembly. In some embodiments, the drill pipe 212A has a wall thickness between about 0.1 inches and about 0.35 inches. In some embodiments, the drill pipe 212A has a wall thickness between about 0.15 inches and about 0.25 inches.

Some embodiments of the present disclosure relate to an operation for breaking threaded components of the drill string. In the operation, the third actuators 208 on the drill assembly are actuated to raise the threaded component of the drill string above the ground. In some embodiments, the threaded joint may be raised about 6 inches to about 8 inches above a foot clamp 210 (shown in FIG. 7A). In some embodiments, the threaded joint may be raised greater than 8 inches above the foot clamp 210. The foot clamp 210 engages with a bottom drill pipe 212' to hold it stationary and the third actuator 108 extends the center of the pair of opposing jaws 102A, 102B around the drill pipe 212A. When the pair of opposing jaws 102A, 102B is centered about the drill pipe 212A, the third actuator 108 enters a float position to self-center the wrench 100 as the first actuator 104 extends to engage the pair of opposing jaws 102A, 102B with the drill pipe 212A. As used herein, the term "float position" refers to an unconstrained position. As used herein, the term "self-center" refers to achieving a neutral centered position with respect to the drill pipe 212A. The fourth actuator 110 takes the float position and the wrench 100 moves away from the foot clamp 210 in a substantially vertical plane as the threaded joint of the drill pipe 212A is separated. The second actuator 106 extends to unthread the upper drill pipe pin out of the lower, stationary drill box. As used herein, the term "rod pin" refers to an external thread, also referred to as the male thread or connector. As used herein, the term "stationary drill box" refers to a receptacle that receives and holds the rod pin, also referred to as the female thread or connector. When the second actuator 106 reaches the end of its stroke, the fourth actuator 110 locks to substantially prevent the wrench 100 from moving in the second plane. The first actuator 104 will then retract to actuate the pair of opposing jaws 102A, 102B from the engaged position to the disengaged position, releasing the drill pipe 212. After the second actuator 106 is fully retracted, the third actuator 108 will retract the wrench 100 to the home position.

Other embodiments of the present disclosure relate to an operation for making threaded components of a drill string where a stationary drill pipe segment is positioned in the foot clamp 210. The upper drill pipe 212A is threaded downward using the drill motor until joint shoulders of the drill pipe 212A and a second drill pipe come into contact. The fourth actuator 110 is then used to locate the wrench 100 on the upper drill pipe 212. The third actuator 108 extends the jaw assembly 102 to a position where the pair of opposing jaws 102A, 102B are centered on the drill pipe 212A. Once centred, the third actuator 108 takes the float position for unrestricted extension and retraction of the jaw assembly 102. The second actuator 106 then extends to pivot the wrench 100 around the drill pipe 212A. When the second actuator 106 has reached the end of its stroke, the first actuator 104 extends to engage the pair of opposing jaws 102A, 102B with the outer surface of the drill pipe 212A. The fourth actuator 110 moves into the float position and the wrench 100 will move downwardly with the drill pipe 212 as the threaded joint is tightened. The second actuator 106 can then retract to tighten the threaded joint. Once a target torque is reached, the second actuator 106 ceases motion and the fourth actuator 110 enters a holding state. As used herein, the term "holding state" refers to a substantially stationary position. The first actuator 104 extends to open the pair of opposing jaws 102A, 102B, the second actuator 106 retracts, and the third actuator engages to return the wrench 100 to the home position.

In some instances, the wrench 100 is used to make or break a joint between the drill motor and the drill sub. In these instances, the operation will be reversed from the drill pipe make joint and break joint described herein to account for the direction of the threads on the drill motor. In some embodiments, making and breaking a joint between the drill motor and the drill sub comprises rotating the bottom threaded joint rather.

The foregoing discussion includes descriptions of making and breaking threaded connections between two sections of drill pipe and between the drill motor and the drill sub. However, the skilled person will appreciate that other drill-string components can be threadably connected or disconnected from the drill string by the embodiments of the present disclosure without damaging the thin-walls of such drill-string components.

The invention claimed is:

1. A wrench for loosening or tightening a threaded joint of two drill-string components, the wrench comprising:

(a) a jaw assembly comprising a pair of opposing jaws configured to engage therebetween an outer surface of a first drill-string component;

(b) a first actuator configured to actuate the pair of opposing jaws between an engaged position and a disengaged position;

(c) a second actuator configured to pivot the jaw assembly and configured for applying a torque to the outer surface of the first drill-string component when engaged therewith;

(d) a third actuator configured to extend and retract the jaw assembly in a first plane that is substantially perpendicular to a longitudinal axis of the drill-string component when engageable with the jaw assembly; and (e) a fourth actuator configured to actuate the wrench in a second plane substantially parallel to the longitudinal axis of the drill-string component when engageable with the jaw assembly.

2. The wrench of claim 1, wherein the first drill-string component has outer diameter between about 2.25 inches and about 5.5 inches.

3. The wrench of claim 1, wherein the first drill-string component has a wall thickness of between about 0.1 inches and about 0.35 inches.

4. The wrench of claim 1, further comprising a mounting member configured to mount the wrench on the drill assembly and further configured to operatively couple with the fourth actuator.

5. The wrench of claim 4, wherein the mounting member is configured to mount the wrench to a drill slide of a drill assembly.

6. The wrench of claim 5, wherein feed cylinders of a drill assembly are configured to actuate movement of the wrench along slide rails of a drill slide.

7. The wrench of claim 6, wherein the linear actuator is one of a hydraulically-powered cylinder, a pneumatically-powered cylinder and an electrically-powered cylinder.

8. The wrench of claim 1, wherein one or more of the first actuator, the second actuator, the third actuator and the fourth actuator is a linear actuator.

9. The wrench of claim 1, wherein the third actuator is a pair of actuators.

10. The wrench of claim 1, wherein the torque is between about 1 pound-foot and about 6,500 pound-foot.

11. The wrench of claim 1, wherein the first drill-string component is one of a drill pipe, a drill sub and a drill bit.

12. A wrench for loosening or tightening a threaded joint of two drill-string components, the wrench comprising:

(a) a jaw assembly comprising a pair of opposing jaws configured to engage therebetween an outer surface of a first drill-string component;

(b) a first actuator configured to actuate the pair of opposing jaws between an engaged position and a disengaged position;

(c) a second actuator configured to pivot the jaw assembly and configured for applying a torque to the outer surface of the first drill-string component when engaged therewith;

(d) a third actuator configured to extend and retract the jaw assembly in a first plane that is substantially perpendicular to a longitudinal axis of the drill-string component when engageable with the jaw assembly; and (e) a frame plate comprising a track configured to guide movement of a bushing connected to an end of the third actuator, the track comprising a first portion and a second portion, wherein the first portion is configured to position the jaw assembly in alignment with an engageable drill-string component and the second portion is configured to guide the bushing for establishing alignment between a center position of the jaw assembly and the longitudinal axis of the engageable drill-string component when the second actuator pivots the jaw assembly.

13. A wrench for loosening or tightening a threaded joint of two drill-string components, the wrench comprising:

(a) a jaw assembly comprising a pair of opposing jaws configured to engage therebetween an outer surface of a first drill-string component;

(b) a first actuator configured to actuate the pair of opposing jaws between an engaged position and a disengaged position;

(c) a second actuator configured to pivot the jaw assembly and configured for applying a torque to the outer surface of the first drill-string component when engaged therewith;

(d) a third actuator configured to extend and retract the jaw assembly in a first plane that is substantially perpendicular to a longitudinal axis of the drill-string component when engageable with the jaw assembly; and (e) at least one jaw insert configurable to engage with an outer surface of a first drill-string component, wherein the first drill-string component has an outer diameter between about 2.25 inches and about 5.5 inches.

* * * * *